US006747410B1

(12) United States Patent
Yokoyama et al.

(10) Patent No.: US 6,747,410 B1
(45) Date of Patent: Jun. 8, 2004

(54) DISPLAY PANEL AND DISCHARGE TYPE DISPLAY APPARATUS HAVING MIXTURE OF THREE GASES

(75) Inventors: Atsushi Yokoyama, Yokohama (JP); Keizo Suzuki, Kodaira (JP); Takahisa Mizuta, Yokohama (JP); Akitsuna Yuhara, Tokyo (JP); Masaji Ishigaki, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/379,471

(22) Filed: Aug. 24, 1999

(30) Foreign Application Priority Data

Aug. 26, 1998 (JP) ..... 10-240231

(51) Int. Cl.[7] ..... H01J 17/49
(52) U.S. Cl. ..... 313/584; 313/484; 315/169.4
(58) Field of Search ..... 315/169.1, 169.4; 313/581–587, 567, 574, 575, 643, 642, 483, 484, 641

(56) References Cited

U.S. PATENT DOCUMENTS

| | | | | | |
|---|---|---|---|---|---|
| 4,914,347 | A | | 4/1990 | Osawa et al. | |
| 5,210,468 | A | * | 5/1993 | Yoshioka | 313/485 |
| 5,754,003 | A | * | 5/1998 | Murai et al. | 313/582 |
| 5,770,921 | A | | 6/1998 | Aoki et al. | |
| 6,084,349 | A | * | 7/2000 | Ueoka et al. | 313/587 |
| 6,107,739 | A | * | 8/2000 | Ha | 313/582 |
| 6,172,461 | B1 | * | 1/2001 | Ha | 313/585 |
| 6,194,831 | B1 | * | 2/2001 | Park et al. | 313/582 |
| 6,232,717 | B1 | * | 5/2001 | Oida et al. | 313/586 |

FOREIGN PATENT DOCUMENTS

| | | | | |
|---|---|---|---|---|
| JP | 6-342631 | | 12/1994 | |
| JP | 7-21928 | | 1/1995 | |
| JP | 7-134948 | | 5/1995 | |
| JP | 07-134948 | | 5/1995 | |
| JP | 09-320474 | | 12/1997 | |
| JP | 10-125237 | | 5/1998 | |
| JP | 2000188062 | A * | 12/1998 | H01J/11/00 |

* cited by examiner

*Primary Examiner*—Vip Patel
*Assistant Examiner*—Karabi Guharay
(74) *Attorney, Agent, or Firm*—Mattingly, Stanger & Malur, P.C.

(57) ABSTRACT

A discharge type display apparatus for displaying images through discharges in a discharge gas enclosed in discharge spaces of the apparatus. The discharge gas is a mixed gas including at least Xe, He and Ne. A mixed ratio of He to Ne in the gas mixture is set approximately for 50% in volume at most.

2 Claims, 6 Drawing Sheets

| SYMBOL | Xe [%] | He [%] | Ne [%] |
|---|---|---|---|
| ■ □ | 4 | 0 | 96 |
| ● ○ | 4 | 15 | 81 |

SOLID BLACK SQUARE / CIRCLE : LOWER LIMIT OF OPERATING MARGIN

HOLLOW SQUARE / CIRCLE : UPPER LIMIT OF OPERATING MARGIN

◇ OPERATING MARGIN REDUCED BY CROSS TALK

| SYMBOL | Xe [%] | He [%] | Ne [%] |
|---|---|---|---|
| ■ □ | 4 | 0 | 96 |
| ● ○ | 4 | 66 | 30 |

SOLID BLACK SQUARE / CIRCLE : LOWER LIMIT OF OPERATING MARGIN

HOLLOW SQUARE / CIRCLE : UPPER LIMIT OF OPERATING MARGIN

◇ OPERATING MARGIN REDUCED BY CROSS TALK

X
GND
PR
PSX

Y
GND
PSY
PSC

A
GND
PA
PSA
TR
TA
TS

DISPLAY PANEL AND DISCHARGE TYPE DISPLAY APPARATUS HAVING MIXTURE OF THREE GASES

BACKGROUND OF THE INVENTION

The present invention relates to a discharge type display apparatus such as a plasma display panel utilizing gas discharge for display.

Plasma display panels (PDPs) are typically known as a discharge type display apparatus utilizing a three-component mixed gas made of He (helium), Ne (neon) and Xe (xenon), as described illustratively in Japanese Unexamined Patent Publication No. Hei 6-342631. With this kind of discharge type display apparatus, the volume ratio of He to Ne is set for 6:4 through 9:1, and the volume ratio of Xe to the entire gas is set for 1.5 through 10%. The PDP of the disclosed technique envisages attaining a high level of radiation efficiency on a reduced drive voltage (sustain voltage).

SUMMARY OF THE INVENTION

One disadvantage of the PDP cited above is that the mixed ratio of the mixed gas used therein leads to an increased firing voltage accompanied by a reduced operating margin. The operating margin is defined as a voltage range from the lowest to the highest sustain voltage. The lowest sustain voltage is determined by a firing voltage, i.e., a minimum voltage required to illuminate specific cells (called light-emitting cells hereunder) selected during an addressing period. The highest sustain voltage is determined by a maximum voltage that will not let illumination be disabled primarily by self-erasure caused by a wall charge. A surge in the firing voltage and a drop in the operating margin are bound to pose constraints on the setting of sustain voltage values. This arrangement has not been quite satisfactory in terms of the ease of drive.

Typically, AC (alternate current) type PDPs are driven in general by having light-emitting cells selected by write discharge operations. At the write discharge stage, it is necessary to develop exact quantities of charges in electrodes.

However, it is general practice not to furnish the AC type PDP with barrier ribs in a direction perpendicular to address electrodes. At the time of write discharge, required quantities of charges may not be formed in the selected light-emitting cells because of the diffusion of charges (called cross talk) to adjacent cells not divided by barrier ribs. That is, cross talk also reduces the operating margin by restricting its upper limit.

Such problems have not been dealt with by the above-cited conventional technique. It is therefore an object of the present invention to overcome the above and other disadvantages of the prior art and to provide a display apparatus capable of minimizing drops in the operating margin caused by cross talk while reducing defective charges provoked by cross talk.

In carrying out the invention and according to one aspect thereof, there is provided a discharge type display apparatus for displaying images by means of discharges in a discharge gas enclosed in discharge spaces, wherein the discharge gas is a mixed gas including at least Xe, He and Ne, and wherein a mixed ratio of He to Ne is set for about 50% in volume at most.

The inventive discharge type display apparatus above suppresses adverse effects of cross talk so as to keep the upper limit of the operating margin approximately constant, thereby maintaining a wide operating margin.

Other objects, features and advantages of the invention will become more apparent upon a reading of the following description and appended drawings.

DETAILED DESCRIPTION OF THE PREFERRED EMBODIMENT

Figure 4:
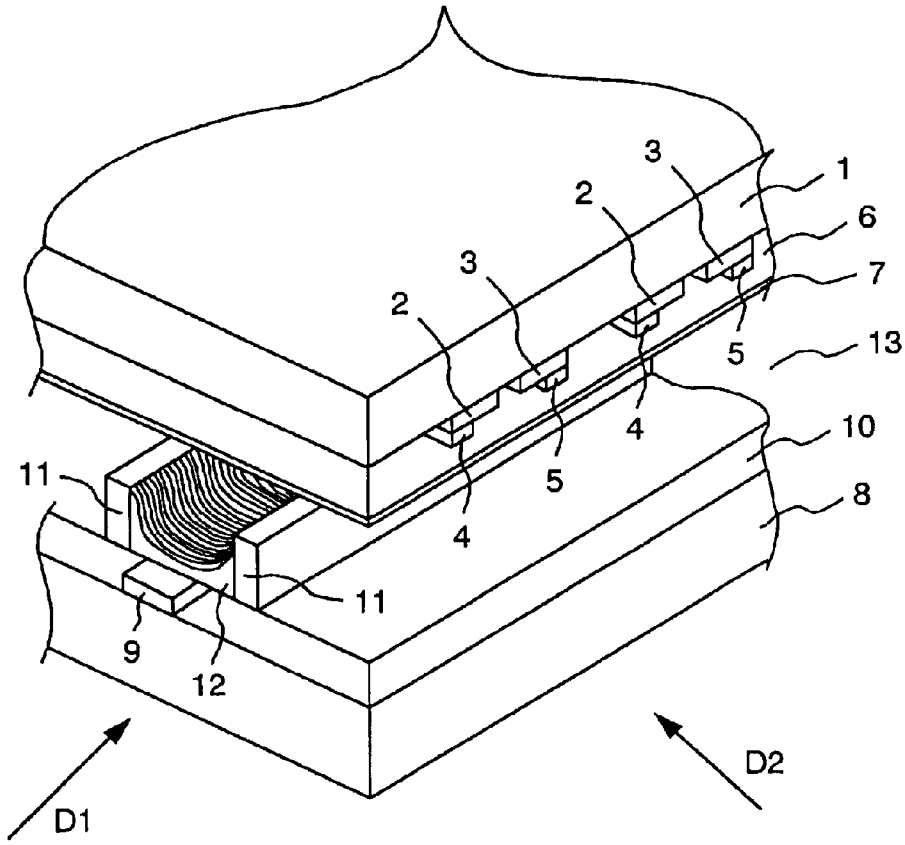
FIG. 4 is an exploded perspective view of an enlarged portion of the PDP embodying the invention.

A preferred embodiment of this invention will be described in the form of a plasma display panel (PDP) with reference to the accompanying drawings. FIG. 4 is an exploded perspective view of an enlarged portion of the PDP embodying the invention. Reference numeral 1 stands for a front glass substrate; 2 for X electrodes; 3 for Y electrodes; 4 for X bus electrodes; 5 for Y bus electrodes; 6 for a dielectric layer; 7 for a protecting layer; 8 for a rear glass substrate; 9 for address electrodes; 10 for a dielectric layer; 11 for barrier ribs; 12 for phosphor; and 13 for discharge spaces.

In FIG. 4, under the front glass substrate 1 are transparent X and Y electrodes 2 and 3 arranged alternately and in parallel with one another. Each X electrode 2 is stacked with an X bus electrode 4 and each Y electrode 3 with a Y bus electrode 5. The X electrodes 2, Y electrodes 3, X bus electrodes 4 and Y bus electrodes 5 are covered with the dielectric layer 6. A surface of the dielectric layer 6 is furnished with the protecting layer 7 illustratively composed of MgO.

Above the rear glass substrate 8 are the address electrodes 9 arranged equal distances apart and in perpendicular relation to the X and Y electrodes 2 and 3 attached to the front glass substrate 1. The address electrodes 9 are covered with the dielectric layer 10. The barrier ribs 11 are interposed parallelly between the paired address electrodes 9 on the dielectric layer 10. The wall surface of each barrier rib 11 and the top of the dielectric layer 10 are coated with the phosphor 12.

The front glass substrate 1 is positioned opposed to the rear glass substrate 8 so that the surface of the protecting layer 7 comes into contact with the top face of the barrier ribs 11. The discharge spaces 13 are each enclosed by the protecting layer 7, barrier ribs 11 and dielectric layer 10. In each discharge space 13, the wall surface of the barrier rib 11 and the top face of the dielectric layer 10 are coated with the phosphor 12. Also in each of the discharge spaces 13 divided by the barrier ribs 11, a region comprising a pair of an X electrode 2 and a Y electrode 3 constitutes a cell that is a pixel unit.

Figure 5:
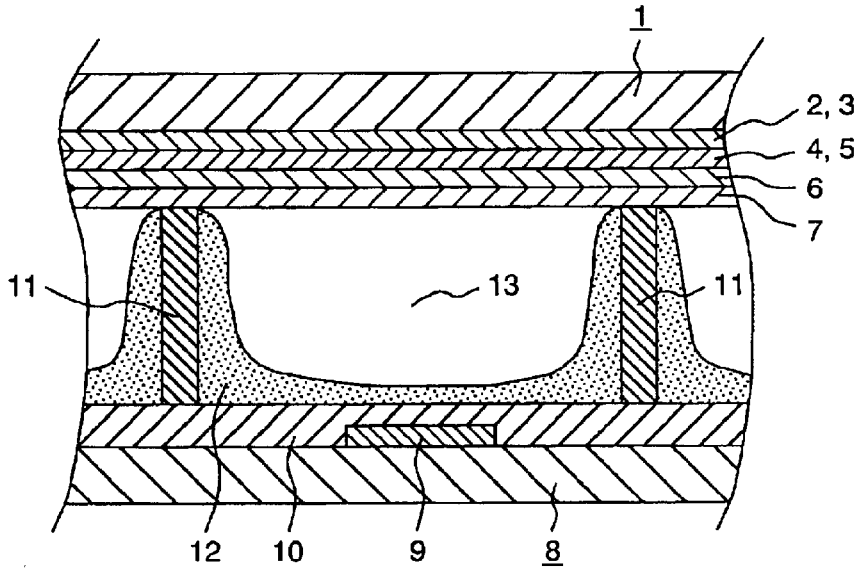
FIG. 5 is a cross-sectional view of the PDP in FIG. 4 taken in an arrowed direction D1.
Figure 6:
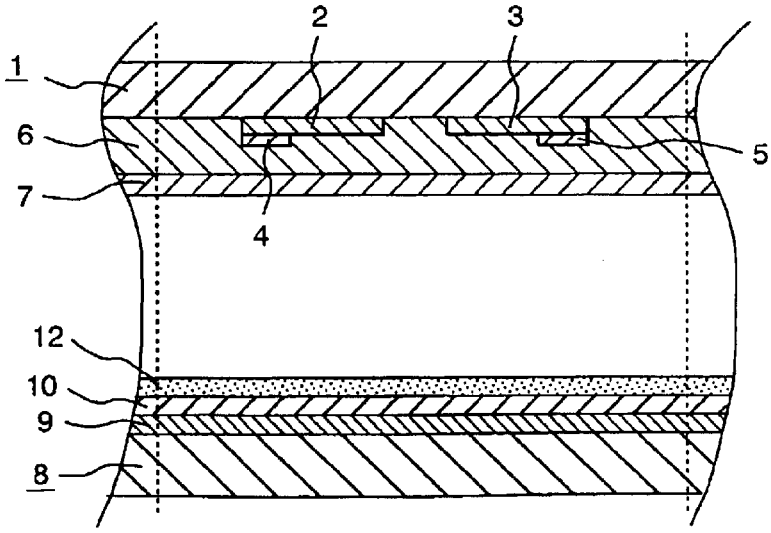
FIG. 6 is a cross-sectional view of the PDP in FIG. 4 taken in an arrowed direction D2.

FIG. 5 is a cross-sectional view of the PDP in FIG. 4 taken in an arrowed direction D1 and showing a single cell. Those parts already shown in FIG. 4 are indicated by like reference numerals. FIG. 6 is a cross-sectional view of the PDP in FIG. 4 taken in an arrowed direction D2 and also showing a single cell. Those parts that already appeared in FIG. 4 are denoted by like reference numerals. Although broken lines are used in FIG. 6 to indicate cell boundaries, cells are not actually segmented by walls as might be suggested by the lines.

In FIGS. 5 and 6, each address electrode 9 is shown located in the middle of two contiguous barrier ribs 11. Each discharge space 13 formed by the front glass substrate 1, rear glass substrate 8 and barrier ribs 11 is filled with discharge gas in which electrical discharging is effected. A potential difference produced at least between two of the X electrode 2, Y electrode 3 and address electrode 9 triggers electrical discharging in the discharge space 13. The execution of an electrical discharge brings the discharge gas into a plasma state in which positively and negatively charged particles coexist.

Figure 7A:
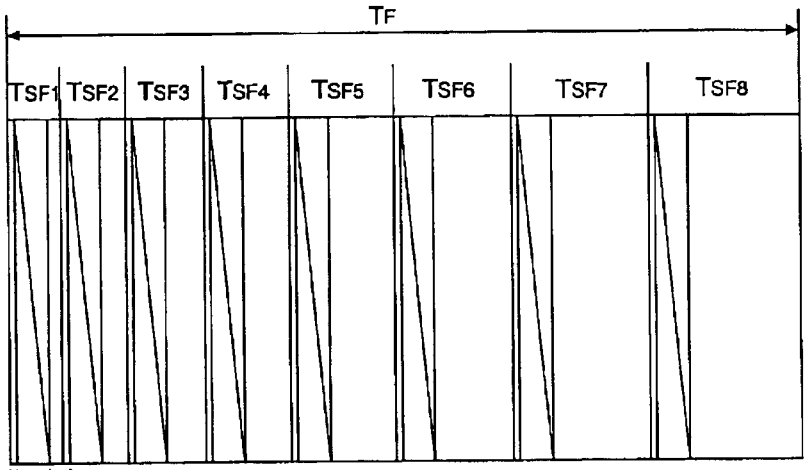
FIGS. 7A and 7B are schematic views showing how the PDP functions during one field period.
Figure 7B:
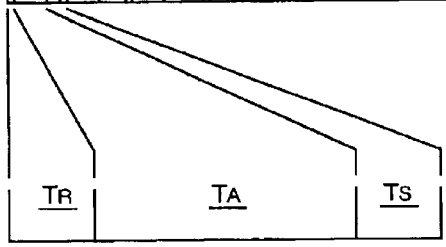

FIGS. 7A and 7B are schematic views showing in what manner the PDP of FIG. 4 needs to function in order to display an image (of a field ) during one field period.

In FIG. 7A, one field $T_F$ is divided into a plurality of subfields $T_{SF1}, T_{SF2}, \ldots, T_{SF8}$. As depicted in FIG. 7B, each subfield $T_{SF}$ comprises three periods: a reset discharge period $T_R$, an address discharge period $T_A$ that defines light-emitting cells, and a sustain discharge period $T_S$.

Figures 8A, 8B, 8C:
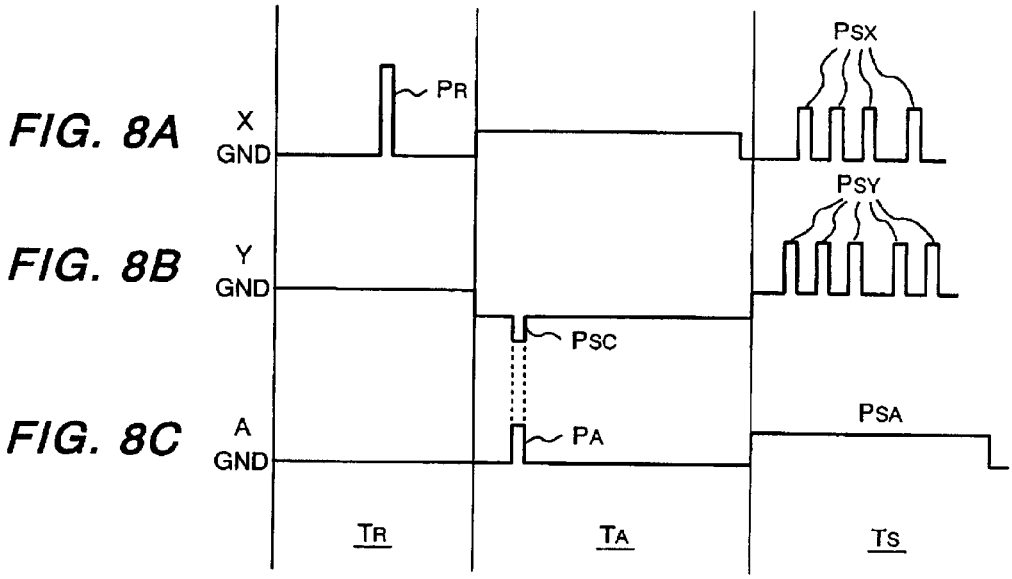
FIGS. 8A, 8B and 8C are waveform charts of voltages each applied in a single subfield shown in FIGS. 7A and 7B.

FIGS. 8A, 8B and 8C are waveform charts showing voltages applied to the electrodes 2, 3 and 9 during the periods $T_R$, $T_A$ and $T_S$ of a single subfield $T_{SF}$. FIG. 8A illustrates a waveform of the voltage applied to the X electrode 2; FIG. 8B depicts a waveform of the voltage applied to the Y electrode 3; and FIG. 8C indicates a waveform of the voltage applied to the address electrode 9.

In FIGS. 8A through 8C, a reset pulse $P_R$ is applied to the X electrode 2 during the reset discharge period $T_R$. During the address discharge period $T_A$, a scan pulse $P_{SC}$ is applied to the Y electrode 3 and an address pulse to the address electrode 9 at the same time. During the sustain discharge period $T_S$, a sustain pulse $P_{SX}$ is applied to the X electrode 2, a sustain pulse $P_{SY}$ to the Y electrode 3, and an all-address pulse $P_{SA}$ to the address electrode 9. The X sustain pulse $P_{SX}$ and Y sustain pulse $P_{SY}$ are fed alternately whereas the all-address pulse $P_{SA}$ is supplied constantly throughout the sustain discharge period $T_S$. A ground potential (GND) is not limited to 0 V.

During the reset discharge period $T_R$, a discharge caused by the reset pulse $P_R$ fed to the X electrode 2 erases the electrical charge accumulated in the dielectric layer 6. Thereafter, applying the address pulse $P_A$ to the address electrode 9 while the scan pulse $P_{SC}$ is being fed to the Y electrode 3 triggers a write discharge in the cell at a point of intersection between the Y electrode 3 and the address electrode 9.

During the address discharge period $T_A$, the X electrode 2 is held at a positive voltage with respect to the ground potential, and the Y electrode 3 is retained at a negative voltage relative to the ground potential. This allows the X and Y electrodes 2 and 3 to accumulate electrical charges generated by the write discharge. As a result, a negative potential is stored in the dielectric layer 6 near the X electrode 2 and a positive potential is accumulated in the dielectric layer 6 close to the Y electrode 3. In such a state, applying the scan pulse $P_{SC}$ to the Y electrode 3 and the address pulse $P_A$ to the address electrode 9 triggers a write discharge in the cell at a point of intersection between the two electrodes 3 and 9. That cell becomes a light-emitting cell. If the address electrode 9 is held at the ground potential, the cell does not develop a write discharge and remains unlit.

Each discharge space 13 in the PDP of the above-described structure contains as a discharge gas a mixed gas including at least He, Ne and Xe. As will be discussed later, the mixed ratio of He is set for 5 through 50% so as to suppress faulty discharge caused by cross talk while maintaining a wide operating margin. The mixed ratio of Xe is set for 1 through 10% in order to restrict the maximum drive voltage. The symbol "%" stands for volume percentage (or molar concentrations).

Figure 1A:
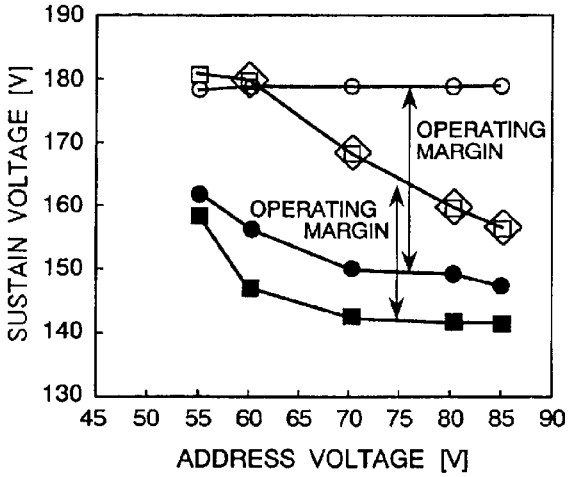
FIGS. 1A and 1B are graphic representations showing results of experiments on the operating margin of drive voltages (sustain voltages) for a plasma display panel (PDP) using each of two kinds of discharge gas for comparison: a three-component mixed gas containing He, Ne and Xe, and a two-component gas made of Ne and Xe.
Figure 1B:
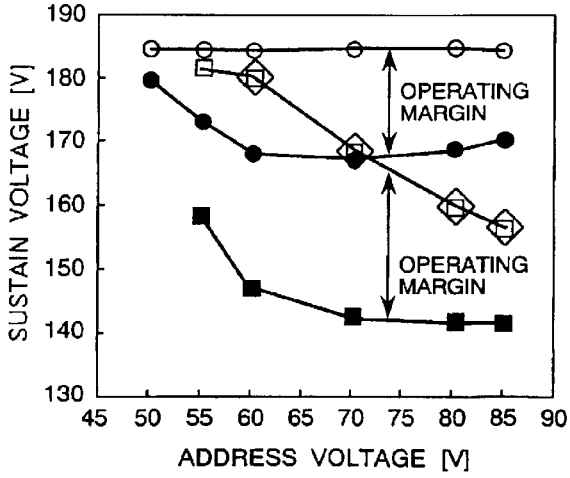

The gases used in the embodiment will be described. FIGS. 1A and 1B compare the inventive three-component mixed gas made of Xe, He and Ne, with a conventional two-component mixed gas composed of Xe and Ne in terms of operating margins. The axis of abscissa represents voltage values of the address pulse $P_A$ (address voltages), and the axis of ordinate denotes voltage values of the X and Y sustain pulses $P_{SX}$ and $P_{SY}$ (sustain voltages). The figures show results of experiments yielding the upper and lower limits of sustain voltages permitting sustainable drive with regard to different address voltages. The experiments employed a PDP having a diagonal length of 25 inches with the XGA resolution. The PDP had a cell pitch, of 165 $\mu$m.

FIG. 1A shows the characteristics of a three-component mixed gas containing 15% of He, 81% of Ne and 4% of Xe in comparison with a conventional two-component mixed gas consisting of 96% of Ne and 4% of Xe. FIG. 1B illustrates the characteristics of a three-component mixed gas made of 66% of He, 30% of Ne and 4% of Xe as opposed to the conventional two-component mixed gas composed of 96% of Ne and 4% of Xe. In FIG. 1A, a line connecting solid black squares denotes lower operating margin limits of the two-component gas with 96% of Ne and 4% of Xe, and a line connecting hollow squares indicates upper operating margin limits of the same gas; a line linking solid black circles depicts lower operating margin limits of the three-component gas with 15% of He, 81% of Ne and 4% of Xe, and a line linking hollow circles represents upper operating margin limits of the same gas. In FIG. 1B, a line connecting solid black squares denotes lower operating margin limits of the two-component gas with 96% of Ne and 4% of Xe, and a line connecting hollow squares indicates upper operating margin limits of the same gas; a line linking solid black circles depicts lower operating margin limits of the three-component gas with 66% of He, 30% of Ne and 4% of Xe, and a line linking hollow circles represents upper operating margin limits of the same gas.

A region between the line connecting the solid black squares and the line linking the hollow squares constitutes a range of sustain voltages on which light-emitting cells are normally driven given an address voltage in the presence of the two-component gas with 96% of Ne and 4% of Xe. That sustain voltage range represents the operating margin in effect when the two-component gas is utilized. Similarly, a region between the line connecting the solid black circles and the line linking the hollow circles denotes a range of sustain voltages on which light-emitting cells are normally driven given an address voltage in the presence of either the three-component gas with 15% of He, 81% of Ne and 4% of Xe, or the three-component gas with 66% of He, 30% of Ne and 4% of Xe. The sustain voltage range likewise provides the operating margin in effect when the three-component mixed gas is employed.

Where the conventional two-component gas with 96% of Ne and 4% of Xe is used, as shown in FIGS. 1A and 1B, the upper operating margin limit drops abruptly as the address voltage is raised progressively. That is, the operating margin narrows suddenly in response to rising address voltages as indicated by diamond-shaped boxes enclosing the blank squares. The abrupt change is attributable to cross talk that develops between contiguous cells. Such cross talk, when taking place, causes in particular contours of displayed images to flicker on the screen. Such faulty light emission leads to deterioration of displayed image quality. This poses constraints on the upper limit of the operating margin.

On the other hand, where the three-component gas is utilized, whether it contains 15% of He, 81% of Ne and 4% of Xe, or 66% of He, 30% of Ne and 4% of Xe, no appreciable decline is observed in the upper operating margin limit despite increased address voltages. The experiments showed the upper limit being kept approximately constant and detected no sudden drop in the operating margin.

As is evident from the comparison of FIGS. 1A and 1B, the operating margin was narrower when the three-component gas with 66% of He, 30% of Ne and 4% of Xe was used than when the three-component gas with 15% of He, 81% of Ne and 4% of Xe was utilized. Whereas the upper operating margin limit showed little difference between the two gases, the lower limit rose appreciably higher when the latter gas was used than when the former was employed.

As described, adding He to the two-component mixed gas of Ne and Xe helps inhibit cross talk. Where the three-component gas with 66% of He, 30% of Ne and 4% of Xe is used as shown in FIG. 1B, the lower limit of the operating margin rises higher than when the two-component gas with 96% of Ne and 4% of Xe is provided. But the upper operating margin limit of the two-component gas drops suddenly due to cross talk, which allows the operating margin to stay high despite increased address voltages.

When the mixed ratio of He is increased in the three-component gas of Xe, He and Ne, the lower limit of the operating margin rises progressively whereas the upper limit of the margin shows little sign of change. As indicated in FIG. 1B, when the mixed ratio of He is as high as 66%, the operating margin is reduced considerably.

Figure 2:
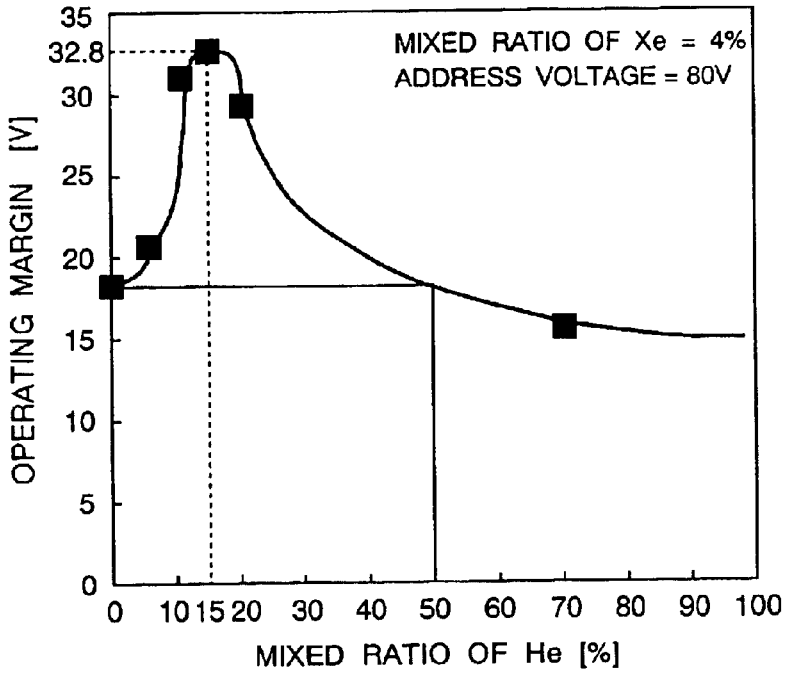
FIG. 2 is a graphic representation depicting results of experiments on changes in the operating margin of drive voltages (sustain voltages) with regard to the mixed ratio of He in the three-component gas containing He, Ne and Xe and used as the discharge gas of the PDP.

FIG. 2 is a graphic representation depicting results of experiments on changes in the operating margin with regard to varying mixed ratios. In the experiments, the mixed ratio of Xe was set for 4% and the address voltage for 80 V.

The mixed ratio of He is defined here as the ratio of He to Ne in a three-component gas of Xe, Ne and He minus the volume (molar concentration) occupied by Xe. If the mixed ratios of Xe, Ne and He in the three-component gas are represented by x%, n% and h% respectively, then the mixed ratio H% of He and the mixed ratio N% of Ne are given as $$H=100\cdot h/(100-x)$$

$$N=100\cdot n/(100-x)$$

If x+n+h=100, then H+N=100. Naturally, if the discharge gas contains any component other than Xe, Ne and He, the mixed ratio of He is still defined as the ratio of He to Ne in the gas mixture minus the volumes (molar concentrations) occupied by Xe and by the added component gas. The above-mentioned x% in the discharge gas denotes the mixed ratio of Xe in the mixture containing Xe and the additional component gas. The axis of abscissa in FIG. 2 represents the mixed ratio H of He.

If the mixed ratio H is 0 in FIG. 2, the operating margin is equal to that which is in effect when the two-component gas of Ne and Xe is used under the same conditions. As the mixed ratio H of He is raised gradually starting from 0, the operating margin is expanded correspondingly. When the mixed ratio H of He is about 15%, the operating margin reaches its peak. As the mixed ratio H of He is further increased, the operating margin drops gradually. The operating margin in effect when the mixed ratio H of He is about 50% is about the same as that given when the mixed ratio is 0%. Further raising the mixed ratio H of He reduces the operating margin progressively.

With this embodiment of the invention, the mixed ratio H of the He is set for 5 through 50% in order to obtain an operating margin at least as wide as that which is given when the two-component gas of Ne and Xe is utilized. Specifically, the mixed ratio H of He is arranged so as not to exceed that of Ne. When the mixed ratio H is converted to the mixed ratio h with respect to the entire gas mixture containing Xe, Ne and He using the expressions above, the ratio h is given as 4.8 through 48.0% because the mixed ratio x of Xe is 4%. The mixed ratio N of Ne is likewise converted to the ratio n of 91.2 through 48.0%.

The Ne gas emits red light when subject to an electrical discharge. This phenomenon, disadvantageous to applications exemplified by the embodiment, is bypassed by including the He gas component in the discharge gas mixture so that red light emission is substantially inhibited. The inventive three-component gas is thus found to provide better chromaticity than the conventional two-component gas of Ne and Xe.

Figure 3:
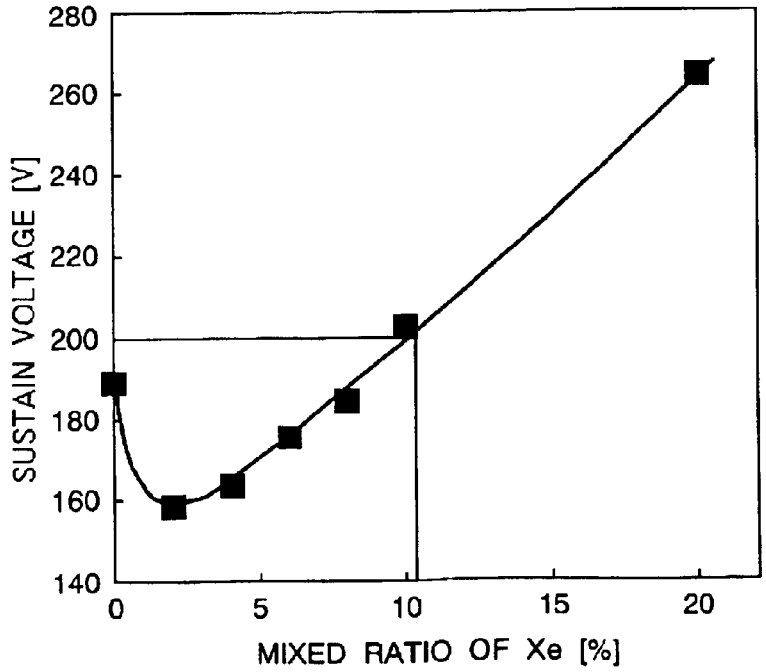
FIG. 3 is a graphic representation illustrating results of experiments on changes in the drive voltage (sustain voltage) relative to the mixed ratio of Xe in the three-component gas containing He, Ne and Xe and used as the discharge gas of the PDP.

FIG. 3 is a graphic representation depicting how the sustain voltage varies with the mixed ratio of Xe when the pressure of the discharge gas is set for 300 Torr. The sustain voltage turned out to be about 200 V when the mixed ratio of Xe was approximately 10%.

Although raising the mixed ratio of Xe improves luminous efficiency, the sustain voltage needs to be raised in keeping with the raised mixed ratio. Since it is common knowledge that the sustain voltage should not be too high in view of drive circuit constraints, this embodiment sets the mixed ratio of Xe for 1 to 10% so that the sustain voltage will not exceed 200 V.

When the mixed ratio of Xe is between 1 and 10%, the operating margin of the sustain voltage with respect to the mixed ratio H of He remains approximately the same as when the mixed ratio x of Xe in FIG. 2 is 4%.

As described above, the preferred embodiment utilizes as a discharge gas a three-component mixed gas containing He, Ne and Xe. The mixed ratio of He as defined above is set approximately for 5 through 50% so that faulty discharge caused by cross talk is suppressed even as a wide operating margin is maintained. In addition, the mixed ratio of Xe is set for about 1 through 10% so that an inordinate surge in the sustain voltage is inhibited.

As described and according to the invention, the three-component mixed gas comprising He, Ne and Xe is used as the discharge gas in which the mixed ratio of He is specifically defined. The gas mixture makes it possible to suppress faulty discharge attributable to cross talk between contiguous cells while maintaining a wide operating margin of the sustain voltage, whereby chromaticity is enhanced as well.

According to the invention, the mixed ratio of the Xe gas component is specifically determined so that the sustain voltage is kept at an appropriate level.

It is to be understood that while the invention has been described in conjunction with a specific embodiment, it is evident that many alternatives, modifications and variations will become apparent to those skilled in the art in light of the foregoing description. Accordingly, it is intended that the present invention embrace all such alternatives, modifications and variations as fall within the spirit and scope of the appended claims.

What is claimed is:

1. A plasma display panel for displaying color images having X electrodes for supplying a sustain pulse and Y electrodes for supplying a scan pulse and a sustain pulse in which said Y electrodes and said X electrodes are arranged alternatively and in parallel with one another, and address electrodes arranged perpendicular to said X and said Y electrodes with a discharge space there between, and enclosing a discharge gas in said discharge spaces for generating ultraviolet rays in a plasma state which is formed by discharging said discharge gas by driving said X electrodes and said Y electrodes after write discharge operations between said Y electrodes and said address electrodes, comprising:

a visible light generating unit for generating visible light by using said ultraviolet rays;

wherein said discharge gas is a mixed gas consisting of Xe, He and Ne, wherein a mixed ratio of Xe to said discharge gas is set from over 1% to 8% in volume at most (1% in volume<mixed ratio of Xe<8% in volume), and wherein a mixed ratio of He to Ne in an He and Ne gas is set from over 8% to 40% in volume at most (8% in volume<mixed ratio of He to Ne in an He and Ne gas<40% in volume) for maintaining an operating margin to be equal to or larger than a predetermined value of a voltage level of the sustain pulse generated between said X electrode and said Y electrode, irrespective of voltage level of the address pulse generated between said address electrode and said Y electrode, thereby suppressing erroneous discharge therebetween.

2. A plasma display panel according to claim 1, further including a phosphor coating disposed in said discharge space on a side of the address electrodes.

* * * * *